United States Patent [19]

Tekulve et al.

[11] 4,097,940

[45] Jul. 4, 1978

[54] HOSPITAL BED HAVING AUTOMATIC CONTOUR MECHANISM

[75] Inventors: Daniel R. Tekulve, Batesville; William H. Peck, Oldenburg, both of Ind.

[73] Assignee: Hill-Rom Company, Inc., Batesville, Ind.

[21] Appl. No.: 740,102

[22] Filed: Nov. 9, 1976

[51] Int. Cl.[2] ..... A47C 3/32

[52] U.S. Cl. ..... 5/66; 5/63; 5/68

[58] Field of Search ..... 5/63, 66–69

[56] References Cited

U.S. PATENT DOCUMENTS

| | | | |
|---|---|---|---|
| 1,908,530 | 5/1933 | Nixon et al. | 5/69 |
| 2,468,765 | 5/1949 | Lorenz | 5/69 |
| 3,051,965 | 9/1962 | Szemplak et al. | 5/68 |
| 3,191,196 | 6/1965 | Holm | 5/68 |
| 3,237,212 | 3/1966 | Hillenbrand et al. | 5/68 |
| 3,398,411 | 8/1968 | Douglass | 5/69 |
| 3,821,821 | 7/1974 | Burst | 5/68 |
| 3,965,500 | 6/1976 | Stein, Jr. | 5/68 |

*Primary Examiner*—Casmir A. Nunberg

[57] ABSTRACT

An electrically operable hospital bed having a main frame, an articulated mattress support frame including head and thigh sections movable to various positions of inclination with respect to the main frame, an operating mechanism for elevating the head section, and an automatic contouring mechanism including linkage interposed between the thigh section and main frame selectively actuable to move in response to elevation of said head section to support and progressively elevate the thigh section. The mechanism may be deactivated to permit elevation of the head section without elevation of the thigh section.

Manual thigh section elevation means are provided with capabilities for further elevation of the thigh section without affecting the automatic mechanism or for operation of the thigh section independently of movement of the head section.

15 Claims, 7 Drawing Figures

Fig. 3.
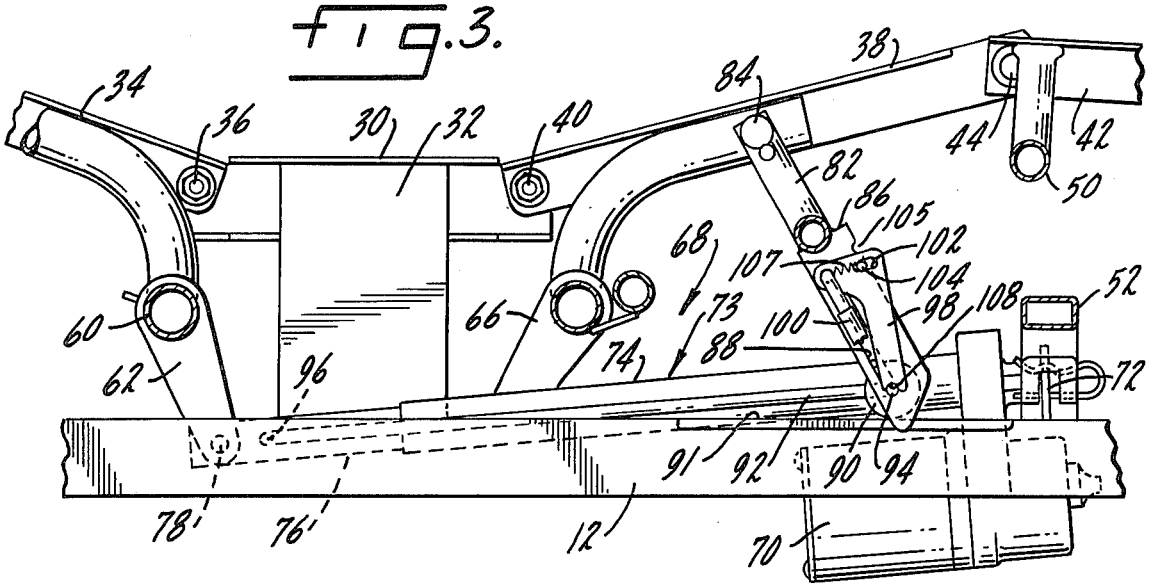
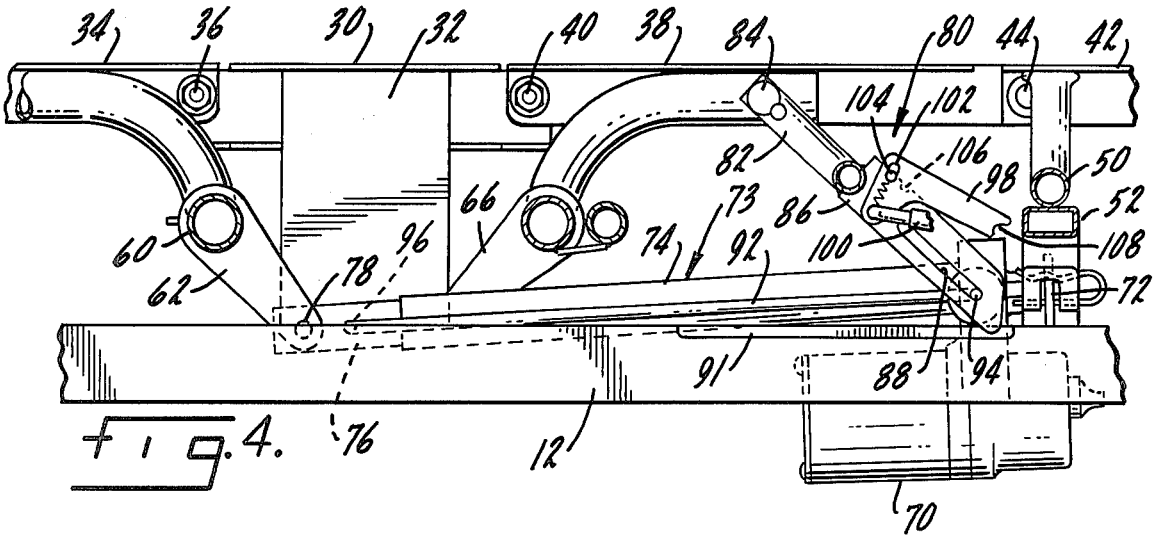
Fig. 4.
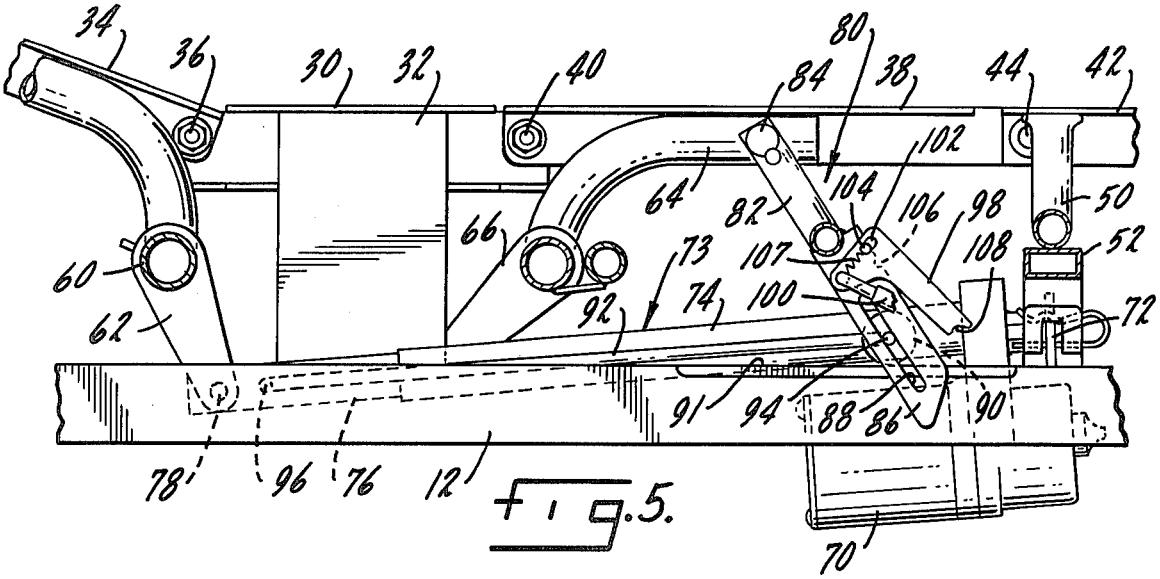
Fig. 5.

HOSPITAL BED HAVING AUTOMATIC CONTOUR MECHANISM

BACKGROUND OF THE INVENTION

This invention relates to electrically operated hospital beds having an articulated mattress support frame. More particularly, it relates to such beds which include a mechanism for selectively providing automatic contour of the mattress support frame by raising the thigh section upon inclination of the head section.

Electrically operable hospital beds of the retractable type are well known in the industry. In such beds elevation of the head section of the mattress support frame produces longitudinal movement of a movable frame with respect to a stationary frame which results in repositioning of the seat section toward the head end of the bed as the head section is elevated. Automatic contouring of the thigh section has been accomplished in such bed designs by utilization of the relative movement between frames to operate mechanisms for elevation of the thigh section as the head section is elevated. Examples are shown in U.S. Pat. Nos. 3,237,212 and 3,821,821.

The advantages of providing automatic contouring of the mattress support frame are well recognized. Automatic elevation of the knees counteracts the forces urging the patient toward the foot end of the bed during elevation of the head end of the mattress support frame. The relative elevation of the thigh section with respect to the degree of elevation of the head section is established by the automatic mechanism and does not require judgment by the operator of the bed controls. In addition, controls are simplified and separate operating components for independent activation of the thigh section are eliminated.

Hospital beds having articulated mattress support frames but which do not include the retractability feature are in common usage and wide demand in the industry. Many, including those that are manually operable, are provided means for automatically raising the thigh section during elevation of the head section. Examples are illustrated in U.S. Pat. Nos. 1,908,530; 3,398,411 and 3,965,500. In each of these arrangements the lifting load resulting from elevation of the thigh section is borne directly or indirectly by the mechanism which elevates the head section. As a result, this mechanism must be adequately sized, adding significantly to its complexity and cost.

A recent advance in the development of electrically operable hospital beds is disclosed in application for U.S. Pat. Ser. No. 659,162 filed Feb. 18, 1976. In that bed design simultaneous elevation of the head and thigh section is accomplished through electronic circuitry. Two separate motors and actuators are provided, one for elevation of the head section and one for elevation of the thigh section.

The bed of the invention includes features which are common to the bed shown in previously mentioned application for United States Letters Patent Serial No. 659,162. The disclosure of that application is accordingly incorporated by reference into this specification.

SUMMARY OF THE INVENTION

The hospital bed of the present invention includes a fixed frame upon which is supported an articulated mattress support frame having a head section positionable in varying degrees of head elevation and a thigh section positionable in varying degrees of knee elevation. An electrically operable actuator mechanism associated with the head section produces movement of the head section to desired positions of inclination.

The automatic contouring mechanism of the bed of the present invention includes selectively actuable linkage interposed between the thigh section and main frame movable in response to movement of the head section to support the thigh section upon the main frame and progressively elevate the thigh section in response to elevation of the head section. The contouring mechanism may be deactivated to permit elevation of the head section only.

Manual thigh section elevation means are provided to supplement the automatic contour mechanism. The manual mechanism may be operated independently of the automatic contour mechanism or may be utilized to provide additional elevation of the thigh section beyond that obtainable through automatic contouring.

DESCRIPTION OF THE DRAWINGS

FIGS. 3, 4 and 5 are fragmentary side elevational views of the hospital bed of FIG. 1 showing particular details and modes of operation of the automatic contour mechanism of the present invention;

DETAILED DESCRIPTION

Figures 1, 2:
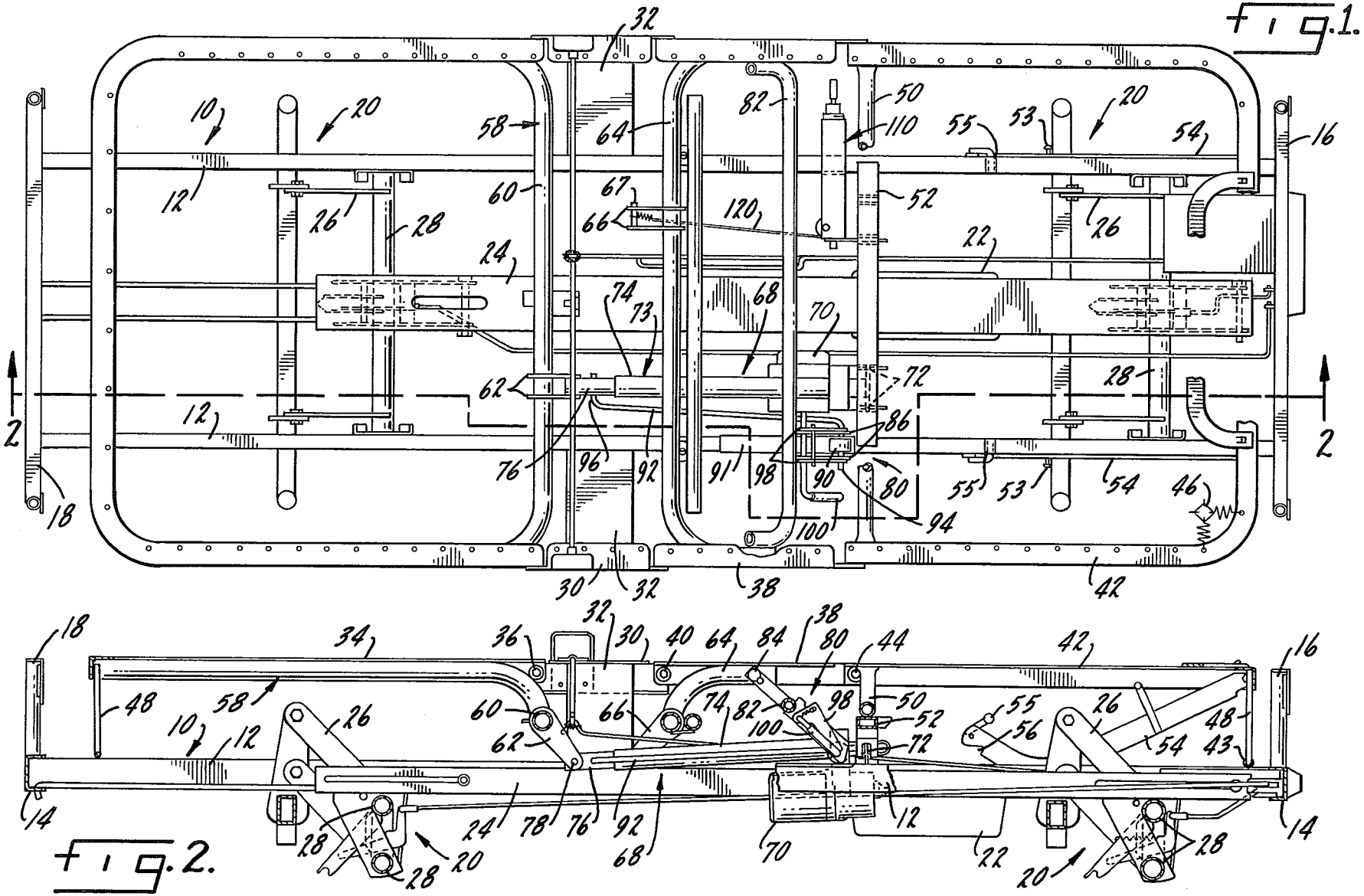
FIG. 1 is a plan view of an electrically operable hospital bed illustrative of the features of the present invention.
FIG. 2 is a side elevational view of the hospital bed of FIG. 1 taken substantially along the line 2—2 of that figure.
Figure 6:
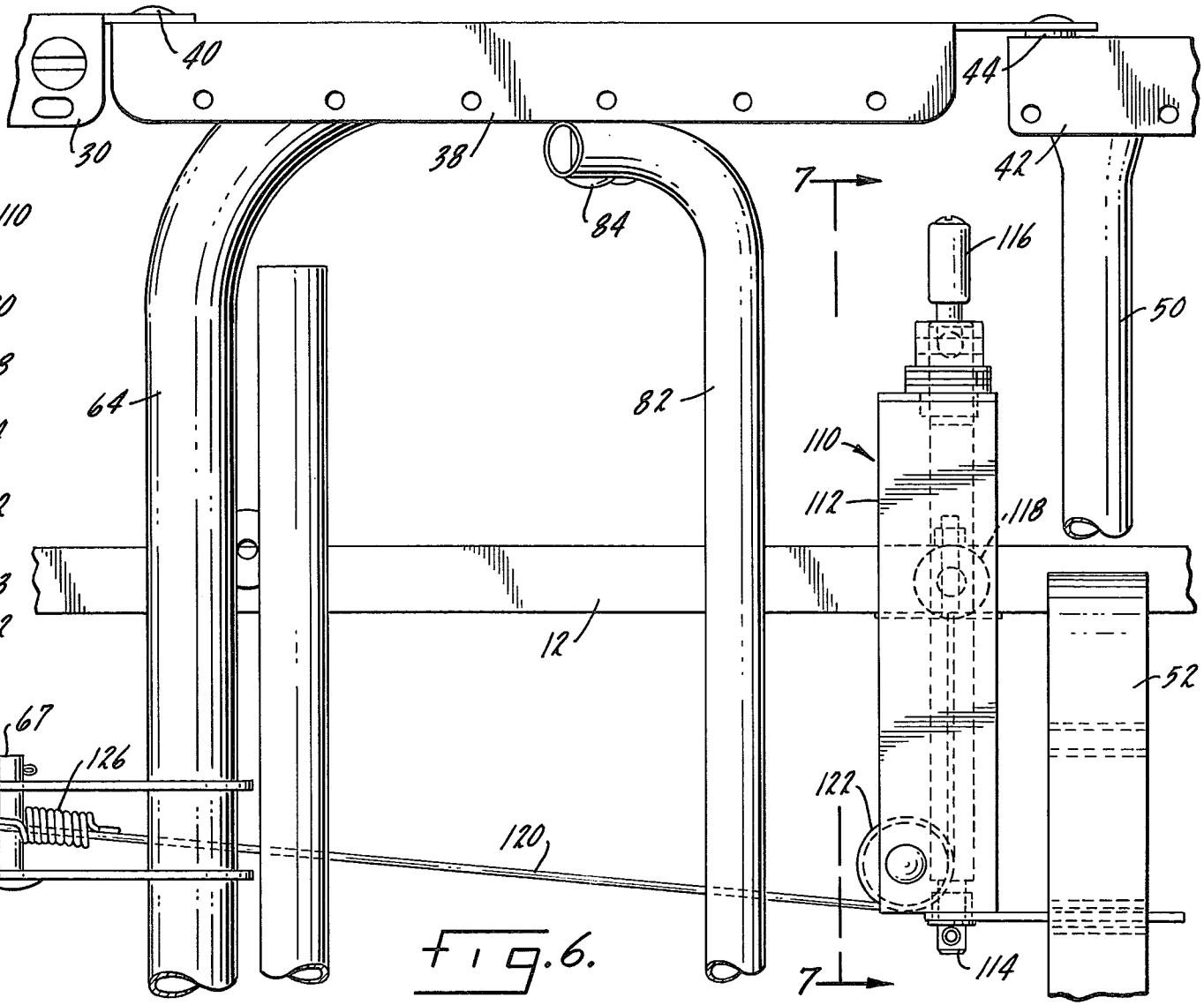
FIG. 6 is a fragmentary elevational view on an enlarged scale of a portion of the hospital bed of FIG. 1 illustrating the manual means for producing elevation of the thigh section of the mattress support frame.

Referring now to the drawings, there is illustrated an electrically operable hospital bed embodying the principles of the present invention.

The hospital bed includes a main frame 10 compromising two elongated frame members 12 interconnected at their ends by cross beams 14. A foot board 16 is supported by the cross beam 14 at the foot end of the bed and a head board 18 is supported by the cross beam 14 at the opposite end.

The main frame 10 is supported upon the floor by a pair of leg assemblies 20. These assemblies are operatively connected to the bed by means adapted to accommodate adjustment of the bed height with respect to the floor and to permit positioning of the main frame in Trendelenburg and Reverse Trendelenburg positions.

The operating means include electric motor 22, drive bar 24, linkages 26 and torque tubes 28. The operation of these components is described in detail in the aforementioned application for U.S. Pat. Ser. No. 659,162. These features are considered merely illustrative. Any suitable form of high-low lift mechanism may be utilized without departing from the spirit and scope of this invention.

The mattress support frame includes a seat section frame 30 secured to the main frame 10 by webs 32 connected to the elongated frame member 12. A head section 34 comprising a peripheral frame is pivotally connected to the seat section by pins 36. Similarly, a thigh section frame 38 is pivotally connected to the opposite edge of the seat sections by pins 40. A foot section 42 in the form of a peripheral frame is pivotally connected to the thigh section at pivot pins 44. Springs 46, partially illustrated in FIG. 1, secured to the frame members complete the mattress support surface.

As best seen in FIGS. 1 and 2, the mattress support frame is supported at the pivotal connection between the thigh section 38 and foot section 42 by a depending support bar 50. In the flat position bar 50 rests upon cross member 52 which is fixed to elongated frame member 12.

A pair of rocker links 54 are pivotally connected adjacent the free end of the foot section 42 of the mattress support frame. These links are manually adjustable to lift the foot section 42 to various positions of elevation by engagement of notches 56 with cooperating stops 53 provided on frame 10. Stop pins 55 are adapted to engage frame member 12 to prevent over adjustment of rocker links 54.

Depending legs 48 are secured to the free ends of the head section 34 and foot section 42 and normally rest on main frame 10. These legs act as levelerizers when the mattress support frame is in the flat position.

Foot end legs 42 are provided with rollers 43. Normally the foot end is held by the rocker links 54. However, when the thigh section 38 is elevated, the foot section 42 may be lowered beyond the position permitted by engagement of notches 56 of links 54 with stops 53. Under those conditions the rollers 43 support the foot end 42 upon the main frame 12 during return movement of the mattress support frame to the flat position.

Head section 34 is provided with a torque transfer tube 58 which is secured along to the longitudinal length of the frame member. It includes a central cross bar 60 spaced downwardly of the mattress support surface. A pair of spaced apart webs are secured to the cross bar 60 to define a bell crank 62. Elevational forces are applied to the bell crank and distributed uniformally to opposite sides of the frame of the head section 34 through the torque transfer tube 58.

The thigh section 38 includes a similar torque transfer tube 64. A bell crank 66 in the form of two parallel plates is affixed to the tube 64. It is provided with a removable cross pin 67. This bell crank is adapted to cooperate with the manual means for elevation of the thigh section as will be explained.

Elevation of the head section 34 is achieved by an operating mechanism generally designated 68. It includes an electric motor and gear box 70 pivotally supported upon the cross member 62 at a connection 72, best seen in FIGS. 1, 3, 4 and 5. This connection allows some pivotal movement of the motor and gear box as is necessary during operation of the elevating mechanism.

The operating mechanism includes an extensible tube 73 having a statutory portion 74 connected to the gear box and motor 70 and a telescoping portion 76 extending from the free end of the stationary portion 74. The extensible tube includes an internal drive screw operable by the motor and gear box. An end of the telescoping portion 76 disposed within the stationary portion 74 includes a nut threadly connected to the drive screw. Operation of motor and gear box 70 causes the nut to move along the drive screw to extend or retract the telescoping portion 76.

A free end of the telescoping portion 76 of the extensible tube is pivotally connected at 78 to bell crank 62 which is connected to torque transfer tube 58. When the mattress support frame is in the flat position as illustrated in FIGS. 2 and 4, the operating mechanism is in its retracted position.

Operation of the head elevation controls (not shown) to elevate the head section energizes the motor 70 to cause rotation of the threaded screw within stationary portion 74 of the extensible tube. The nut fixed to the telescoping portion 76 of the tube 73 moves along the screw urging the telescoping portion 76 outwardly of the stationary position and increasing the length of the extensible tube (FIGS. 3 and 5). This applies a lifting force to bell crank 62 which is transferred through torque transfer tube 58 to the frame of head section 34 causing it to pivot about pins 36 to a desired position of inclination.

In accordance with the present invention, there is provided an automatic contouring mechanism generally designated 80 which is adapted to position the thigh section 38 of the mattress support frame in response to positioning of the head section 34. The mechanism is selectively actuable so that elevation of the head section 34 may be accomplished without elevation of the knees should that be desired.

The automatic contouring mechanism 80 includes a "U" shaped cross tube 82 which is pivotally connected to thigh section 38 by pins 84. The cross tube is intended to distribute lifting loads to opposite sides of the frame 38 during elevation of the thigh section.

As best seen in FIGS. 2–5, a pair of spaced apart plates 86 are secured to the cross tube 82 as by welding or the like. They extend angularly downwardly and are positioned upon opposite sides of one of the elongated frame members 12 of the main frame. Each includes an elongated lost motion slot 88.

The automatic contouring mechanism 80 includes a follower which is operatively associated with the extensible tube 73. The follower is in the form of a roller 90 disposed intermediate the plates 86 in overlying relation to an elongated pad 91 provided upon frame member 12.

The roller is rotatably supported upon an elongated tie rod 92. The tie rod 92 includes an end which defines an axle portion 94 extending outwardly on either side of the roller and through the lost motion slots 88. The opposite end 96 of the tie rod 92 is pivotally connected to the telescoping portion 76 of the extensible tube associated with the head section 34. It should be noted that the longitudinal centerline of extensible tube 73 and tie rod 92 are in general alignment. The axle 94 of roller 92 and the pivotal connection 96 of the tie rod and tube 76 are thus in alignment with the axis of force application of the head end actuator 68.

A pair of spaced apart locking links 97 are disposed outwardly of plates 86. Each locking link 98 is provided with a slot 102 within which is disposed a latch pin 104. The links 98 are secured to an operator handle 100 which is pivotally supported by plates 86. Positioning of the links through use of handle 100 places the contouring mechanism in either an operative or an inoperative modes as will be explained.

The plates 86 are provided with two sets of notches 105, 106 adapted to receive the latch pin 104. Springs 107 interconnected between the latch pin and handle 90 urge the pin toward the plates 86 and releasably retain the pin in one or the other of the notches. Positioning of locking links 98 as shown in FIGS. 4 and 5 with latch pin 104 in notch 105 places the mechanism in the inoperative mode. Positioning the locking links as shown in FIGS. 2 and 3 with latch pin 104 in notch 106 places the mechanism in the operative mode.

Each of the locking links 98 includes a free end defining a seat surface 108. Positioning of the locking links 98 in the operative position as illustrated in FIGS. 2 and 3 places the seat surfaces 108 in operative relation with axle portion 94 of the link 92. In this condition the cross tube 82, pleates 86 and locking links 98 define a collapsible, rigid link extending between axle portion 94 and the pivotal connection 84 of tube 82 to thigh section 34.

The rigid link defined by the tube 82, plates 86 and locking links 98 extends angularly downwardly of the thigh section and is of a length which exceeds the vertical distance between the thigh section 34 and elongated member 12 of main frame 10. As can be appreciated, pivotal movement of the link so defined in a direction toward the head end of the bed places the roller 92 into contact with pad 91 on frame member 12. Continued pivotal movement in the same direction causes the link to exert a lifting force upon thigh section at pins 40 which results in progressive inclination of the thigh section with respect to the seat section 32. The supported load of the elevated thigh section 34 is transferred directly to the frame member 12 through the rigid link.

Referring now to FIG. 4, locking links 98 are positioned with latch pins 104 in notches 105. Extension of the telescoping portion 76 of the extensible tube 73 causes pivotal movement of the head section 34 about pin 36. Also elongated tie rod 92 is pulled toward the head end of the bed causing the roller 90 to move in the same direction. The tie rod applies a pulling force upon plates 86 through the interconnection of axle portion 94 with lost motion slots 88 causing plates 86 and cross tube 82 to pivot at pins 40. The axle moves along the lost motion slots 88 as the plate pivots toward the head end of the bed. No elevation of the thigh section occurs. As seen in FIG. 5, as pivotal movement of the cross tube 82 and plates 86 occurs, the plates 86 merely pass on opposite sides of the frame member 12.

To activate the automatic contouring mechanism the locking links 98 are pivoted in a direction to cause pin 104 to move into notches 106 (FIGS. 2 and 3). This positions the seat surfaces 108 in cooperative overlying relation to the axle portion 94 on opposite sides of the roller 90.

Energization of the motor 70 to elevate the head section 34 again causes tie rod 92 to pull roller 90 toward the head end of the bed. However, the locking links 98 are positioned such that slot surfaces 108 engage axle portion 94 and preclude movement of the axle portion along lost motion slots 88.

Continued elevation of the head section 34 causes link 90 and roller 92 to continue movement toward the head end of the bed. The roller 92 engages the pad 91. The cross tube 82, plates 86 and locking links 98 define a rigid link extending between roller axle 94 and pivotal connection 40. The rigid link is of a length which exceeds the vertical distance between the thigh section 34 and the main frame 10 when the thigh section is in the flat position.

As seen in FIG. 3, continued pivotal movement about pin 40 causes the rigid link to elevate the thigh section. Maximum elevation is achieved when the link defined by cross tube 82, plates 86 and locking links 98 is in a vertical position.

The lifting forces which support the thigh section 38 in the elevated position are transferred directly to the frame member 12. The link 92 and consequently head section elevating mechanism 68 experience only the horizontal force components of the lifting load which decrease to a minimum as the link moves toward the vertical or maximum lift position. Also the general longitudinal alignment of the tie rod 94 and extensible tube 73 remains generally constant throughout the cycle of movement, thus, avoiding application of bending moment loads upon the tie rod. This is important in that in the event the linkage of contouring mechanism 80 travels slightly beyond the vertical position during the lifting function, loading of the tie rod 92 changes from tension to compression.

The length of plates 86 and locking links 98 are arranged to provide optimum thigh section elevation conjointly with elevation of the head section 34. It has been found desirable to provide a maximum of 18° to 20°. This maximum is reached at an inclination of the head end section 34 of about (35°). The head section 34 may be elevated to a maximum of (60°), however, no appreciable change in thigh section elevation occurs.

Figure 7:
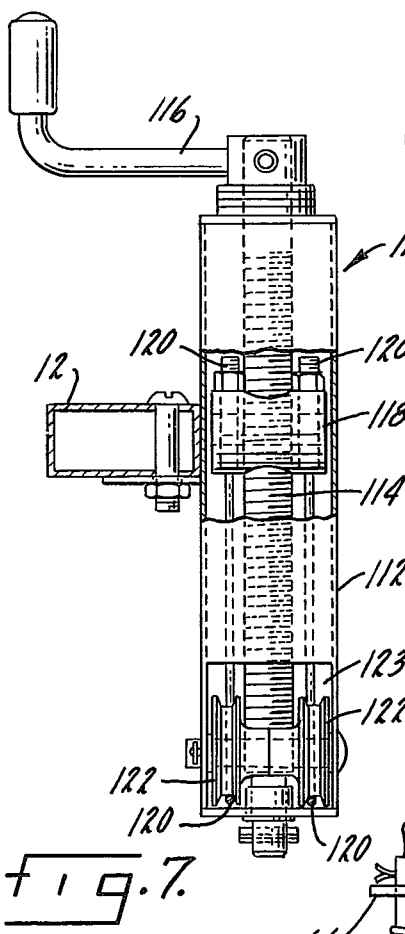
FIG. 7 is a fragmentary view partially in section of a portion of the manual means illustrated in FIG. 6 and taken generally along the line 7—7 of FIG. 6.

In many instances it is desirable to supplement the thigh section elevation provided by automatic contouring mechanism 80 to provide increased elevation of the knees. Also, it has been found beneficial in some instances to provide knee elevation without elevation of the head section 34. The bed of the present invention, therefore, is provided with a manual operator 110 best seen in FIGS. 7 and 8.

The manual operator 110 includes a hollow channel 112 secured to member 12 of the main frame 10 beneath the thigh section 38. It extends generally transversely of the bed on the side opposite to the automatic contouring mechanism 80. A threaded screw 114 is rotatably supported within the Channel 112 and is provided with a crank 116 exposed for use at the side of the bed.

A nut 118 is threadedly engaged with the screw 114 and is sized to preclude rotation within the hollow channel 112. Rotation of the crank 116, therefore, causes the nut to move along the screw 114.

The nut 118 includes vertically aligned apertures which receive and secure ends of a cable loop 120. The cable extends from the nut 118 about guide pulleys 122 and outwardly of the channel through opening 123.

The looped end of the cable 120 surrounds the cross pin 67 of bell crank 66. A spring 126 connected to the pin 67 overlies the looped end of the cable. This keeps the cable in operative engagement with the pin regardless of the existance of slack in the cable during operation of the automatic contour mechanism.

Manual elevation of the thigh section 38 is accomplished by operation of the hand crank 116. Rotation of the crank in the direction to cause the nut 118 to move toward the crank reduces the effective length of the cable loop extending between guide pulleys 122 and cross pin 67. This applies a lifting force upon bell crank 66 which is transferred to thigh section 38 through torque transfer tube 64.

As can be appreciated, the use of the cable loop 120 to translate cranking motion of crank 116 into lifting forces applied to the bell crank 66 has several advantages. The cable 120 prescribes a (90°) bend at guide pulleys 122 and applies lifting forces on bell crank 67 in a direction longitudinally of the bed. This permits the channel 112 to be mounted transversely of the bed with the crank 116 positioned for optimum accessibility by nursing personnel.

Also, automatic elevation of the thigh section 38 by operation of the automatic contouring mechanism 80 is accommodated without affecting operability of the manual operator 110. During elevation of the thigh section 38 by the automatic contour mechanism 80, the bell crank 68 and cross pin 67 move toward the foot end of the bed. This reduces the distance between cross pin 67 and guide pulleys 122. The cable loop 120 acts as a lost motion link and accommodates this reduction without disengagement of the operative components.

To elevate the thigh section 34 beyond the position produced by the automatic contouring mechanism 80, it is only necessary to rotate crank 116 in a direction urging nut 114 toward the crank. This reduces the effective cable length between pin 67 and pulleys 122 until cable loop 120 becomes taut. Further cranking applies lifting forces to pin 67 which accomplishes further inclination of the thigh section 38.

Similarly, the automatic contouring mechanism 80 is adapted to accommodate operation of the manual operator 110. The cross tube 82 is pivotably connected to thigh section 38. The elongated tie rod 92 is pivotably connected to the telescoping member 76 of the extensible tube and the axle portion 94 of the link rests in lost motion slots 88 of plates 86. Operation of the manual mechanism 110 to lift thigh section 38 causes pivot pin 46 to transcribe an accurate path and move upwardly away from main frame 10. This movement causes the cross tube 82 and tie rod link 92 to pivot at their pivotal connections and avoid the application of any force upon telescoping portion 76 of the extensible tube. During this movement, follower 90 is free to move upwardly away from pad 91. Upon lowering of the thigh section 38 by rotation of the crank handle 116 in the opposite direction, the cross tube 82 and tie rod 92 pivot at their pivotal connection. The plates 86 move downwardly toward the frame 10 and the roller 90 returns to its operative position with respect to pad 91.

Various features of the invention have been particularly shown and described. It must be understood that numerous modifications may be made without departing from the scope of the invention.

What is claimed is:

1. An electrically operable bed having a main frame, an articulated mattress support frame supported on said main frame and including a head section and a thigh section movable to various positions of inclination, operating means operatively connected to said head section to elevate said head section to said position of inclination, and an automatic contouring mechanism, including a collapsible linkage selectively actuable to define a rigid link interposed between said thigh section and said main frame which is movable in response to inclination of said head section to support said thigh section on said main frame and progressively elevate said thigh section to said positions of inclination.

2. An electrically operable bed as claimed in claim 1 wherein said collapsible rigid link defined by said linkage has a length which exceeds the vertical distance between said thigh section and said main frame and movement thereof in response to elevation of said head section causes said link to move toward a vertical position to support and progressively elevate said thigh section.

3. An electrically operable bed as claimed in claim 1 wherein said linkage defining said collapsible rigid link includes a cross tube pivotally connected to said thigh section and depending therefrom, a pair of spaced apart parallel plates depending from said cross tube operatively disposed with respect to said main frame, a follower carried by said plates, disposed for engagement with said main frame and operatively connected to said head section operating means for movement in response to elevation of said head section and a pair of locking links connected to said plates positionable to fix the location of said follower with respect to said plates to define said collapsible rigid link.

4. An electrically operatable bed as claimed in claim 3 wherein said collapsible rigid link defined by said cross tube, plates and locking links has a length which exceeds the vertical distance between said thigh section and said main frame, movement of said follower in response to elevation of said head section causing said link to move toward a vertical position and urge said follower into supporting engagement with said main frame to support and progressively elevate said thigh section.

5. An electrically operable bed as claimed in claim 4 wherein said means operating said head section includes an extensible tube operatively connected between said main frame and said head section, and said linkage includes a tie rod connected to said extensible tube for movement in response thereto and includes an end defining an axle portion rotatably supporting said follower and connecting said follower to said plates.

6. An electrically operable bed as claimed in claim 5 wherein the longitudinal axis of said extensible tube and said tie rod are in general alignment and remain in such general alignment during operation of said head section operating means.

7. An electrically operable bed as claimed in claim 5 wherein said plates include lost motion slots receiving said tie rod axle portion supporting said followers, said locking links being positionable between an inoperative position allowing said tie rod axle portion to move within said lost motion slots during elevation of said head section and an operative position with ends thereof in engagement with said axle portion to form said collapsible rigid link.

8. An electrically operable bed as claimed in claim 1 wherein said bed includes manual means for elevating said thigh section independently of said automatic contouring mechanism said thigh section having a bell crank depending therefrom and said manual means including an actuator having means movable in response to manual operation thereof and a cable loop operatively connecting said bell crank and said movable means.

9. A bed as claimed in claim 8 wherein said actuator is a screw and nut type actuator disposed generally transversely of the longitudinal axis of the bed having a handle exposed for use at the side of the bed and wherein said cable loop is connected to the operator nut, and converts transverse movement of said nut of said actuator to movement longitudinally of the bed to apply lifting forces to said bell crank of said thigh section.

10. A bed as claimed in claim 9 wherein said bell crank includes means retaining said cable loop in contact therewith, elevation of said thigh section by said automatic contour mechanism causing said cable loop to become slack intermediate said bell crank and said actuator.

11. An electrically operable bed as claimed in claim 8 wherein said manual means for elevating said thigh section are operable to move said thigh section to positions of incline which exceed the maximum incline provided by said automatic contour mechanism.

12. In an electrically operable bed having a main frame, an articulated mattress support frame supported on the main frame including a head section and a thigh section movable to various positions of inclination and operating means operatively connected to the head section to elevate the head section to the positions of inclination, an automatic contouring mechanism, including a collapsible linkage selectively actuable to define a rigid link to be disposed intermediate the thigh section and the main frame, said link being adapted for movement in response to inclination of said head section to support the thigh section on the main frame and progressively elevate the thigh section to various positions of inclination.

13. In an electrically operable bed as claimed in claim 12 wherein said linkage defining said collapsible rigid link includes a cross tube adapted to be pivotally connected to said thigh section to depend therefrom a pair of spaced apart parallel plates depending from said cross tube for operative disposition with respect to said main frame, a follower carried by said plates disposed for engagement with said main frame and adapted for operative connection to the head section operating means for movement in response to elevation of head section, and a pair of locking links connected to said plates positionable to fix the location of said follower with respect to said plates to define said collapsible rigid link.

14. In an electrically operable bed as claimed in claim 15 wherein said linkage includes a tie rod for connection to said head section operating means having an end defining an axle portion rotatably supporting said follower, said plates include lost motion slots receiving said tie rod axle portion and said locking links being positionable in an inoperative position to allow movement of said axle in said lost motion slots upon elevation of said head section and an operative position with ends thereof in engagement with said axle portion to preclude movement of said axle portion in said lost motion slots to define said collapsible rigid link.

15. In an electrically operable bed as claimed in claim 12, manual means for elevating the thigh section independently of the automatic contour mechanism including an actuator having means movable in response to manual operation thereof and a cable loop operatively connecting the movable means to the thigh section to apply lifting forces thereon.

* * * * *